US006494770B1

(12) United States Patent
Carlson

(10) Patent No.: US 6,494,770 B1
(45) Date of Patent: Dec. 17, 2002

(54) VARIABLE CAMBER SANDING BOARD

(76) Inventor: Gerald Carlson, 700 Wagner La., Kalispell, MT (US) 59901

( * ) Notice: Subject to any disclaimer, the term of this patent is extended or adjusted under 35 U.S.C. 154(b) by 33 days.

(21) Appl. No.: 09/649,287

(22) Filed: Aug. 26, 2000

Related U.S. Application Data

(60) Provisional application No. 60/151,287, filed on Aug. 28, 1999.

(51) Int. Cl.[7] ..... B24B 23/00

(52) U.S. Cl. ..... 451/344; 451/354; 451/495

(58) Field of Search ..... 451/344, 354, 451/495

(56) References Cited

U.S. PATENT DOCUMENTS 3,123,947 A * 3/1964 Rawley ..... 451/495

5,947,803 A * 9/1999 Gruner ..... 451/345

* cited by examiner

*Primary Examiner*—Timothy V. Eley
*Assistant Examiner*—Alvin J. Grant

(57) ABSTRACT

A variable camber sanding board includes a generally planar and flexible sanding base, which is adapted to receive abrasive sheet material. A front frame is pivotably linked to a mid handle via a front pivot connection. The front pivot connection includes a pin passing through coaxial bores formed in the mid handle and front frame. A mid handle includes a slotted attachment member which is pivotably secured to a trigger link, forming a middle pivot connection. The trigger link is pivotably secured to a rear handle which is secured to the sanding base via a rear frame. An adjustment pivot connection includes a pin passing through coaxial bores formed in the slot link and rear frame, respectively. A threaded knob assembly, which passes through a bore located in the trigger link and a slot in the slot link can be selectively tightened in a desired position along the length of the slot link.

19 Claims, 3 Drawing Sheets

VARIABLE CAMBER SANDING BOARD

CROSS-REFERENCE TO RELATED APPLICATIONS:

This application claims priority from U.S. Provisional Application Serial No. 60/151,287, filed Aug. 28, 1999.

STATEMENT AS TO RIGHTS TO INVENTIONS MADE UNDER FEDERALLY-SPONSORED RESEARCH AND DEVELOPMENT:

None

1. Field of the Invention

The invention relates generally to sanding boards. In particular, the invention relates to flexible tools for sanding and shaping workpieces having rounded contours.

2. Description of the Related Art

The use of abrasive-coated sheet material, or "sandpaper", is historically well-known. Records show that the Chinese bonded seashells to parchment with natural gum in the 13th century. Although the details of its construction are sketchy, and abrasive paper was used in Europe in the 1700's. By the 1800's, varnish was used to bond calcined pumice to paper.

Modern "sandpaper" does not use sand at all. Today, extremely hard abrasive particles, known as "mineral", are bound to backing material using complex resins. The mineral is selected on the basis of its durability and its ability to penetrate the surface to be abraded. Typical minerals in general use are Aluminum Oxide and Silicone Carbide. As the objects to be sanded have become more complex, various devices have been developed to apply sandpaper to the surface to be abraded. For example, U.S. Pat. No. 470,794 to Shempp is directed to a holder for supporting a piece of sandpaper in smoothing or polishing moldings and other woodwork having a curved or irregular surface. The holder includes a working edge that can be varied to fit the contour of the molding.

U.S. Pat. No. 1,570,177 to Pointer discloses a sanding block in which a large number of thin metal blades which slide relative to one another to conform to an irregular surface to be sanded.

U.S. Pat. No. 4,137,670 to Goralski shows a hand file board of the type used in repairing damage to the bodies of automobiles. The hand file provides a firm elongate planar support surface against which a sheet of abrasive material may be secured, and front and rear handles which can be used for manipulating the file to shape, sand, or scuff a surface with abrasive material supported on the file board. A central handle is provided between the front and rear handles.

U.S. Pat. No. 4,944,128 to Reiter illustrates a hand sander with an automatic slack take-up feature. The sander includes pairs of cooperating wedges to effect the degree of displacement as the base member is passed over an arcuate surface.

U.S. Pat. No. 5,203,123 to Travis is directed to a deformable sanding block having a central metallic core which is deformable, yet shape-retaining. The core is enclosed totally within an elastomeric covering which is non-abrasive.

U.S. Pat. No. 5,700,187 to Balbi sets forth a tool to stopper and abrade concave and convex surfaces. The tool includes a deformable plastic supporting base plate that may be adjusted to the shape of a surface.

While many of these patents provide sanding surfaces that conform to workpiece shapes, none has the capability to "float", i.e., to flex when encountering changes in contour.

Furthermore, known devices are relatively complex and difficult to adjust. These shortcomings, among others, make known devices unsuitable for use in many automotive bodyshop applications.

It can be seen from the foregoing that the need exists for a relatively simple and inexpensive sanding board capable of conforming to surfaces and conditions encountered in automobile body work.

SUMMARY OF THE INVENTION

These and other objects are achieved by providing a variable camber sanding board. The sanding board includes a generally planar sanding base. The sanding base is relatively flexible, and is adapted to receive sanding media in the form of abrasive sheet material. A front frame is provided on the sanding base. A front handle is mounted on the front frame, and is provided with a grip member. The front frame is pivotably linked to a mid handle via a front pivot connection. The front pivot connection includes a pin passing through coaxial bores formed in the mid handle and front frame. The mid handle includes a slotted attachment member. A bolt assembly pivotably secures the attachment member to a trigger link, forming a middle pivot connection. The trigger link includes a plurality of adjustment bores, which allow the location of the middle pivot connection to be varied by selective placement of the bolt assembly within the various adjustment bores.

The trigger link is pivotably secured to a rear handle via a rear pivot connection. The rear pivot connection includes a pin passing through coaxial bores formed in the trigger link and the rear handle, respectively. The rear handle is secured to the sanding base via a rear frame.

A slot link is pivotably secured to the rear frame via a adjustment pivot connection. The adjustment pivot connection includes a pin passing through coaxial bores formed in the slot link and rear frame, respectively. A threaded knob assembly passes through a bore located in the trigger link and a slot in the slot link. The knob assembly can be selective tightened in place in a desired position along the length of the slot link.

The invention itself, however, both as to organization and method of operation, together with further objects and advantages thereof, may be best understood by reference to the following description taken in conjunction with the accompanying drawings.

DETAILED DESCRIPTION OF A PREFERRED EMBODIMENT

Figure 1:
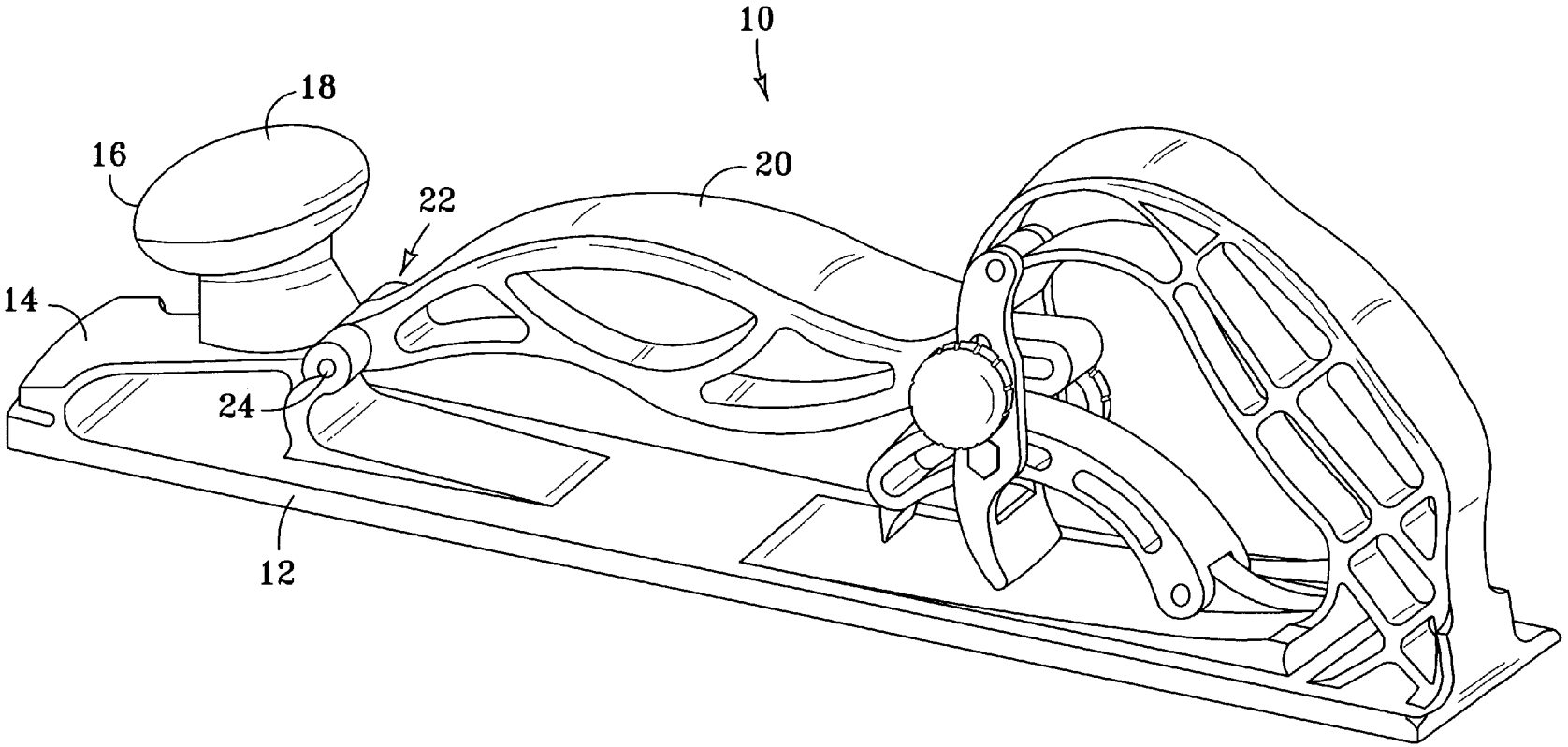
FIG. 1 is a schematic perspective view of a variable camber sanding board in accordance with the principles of the present invention.
Figure 2:
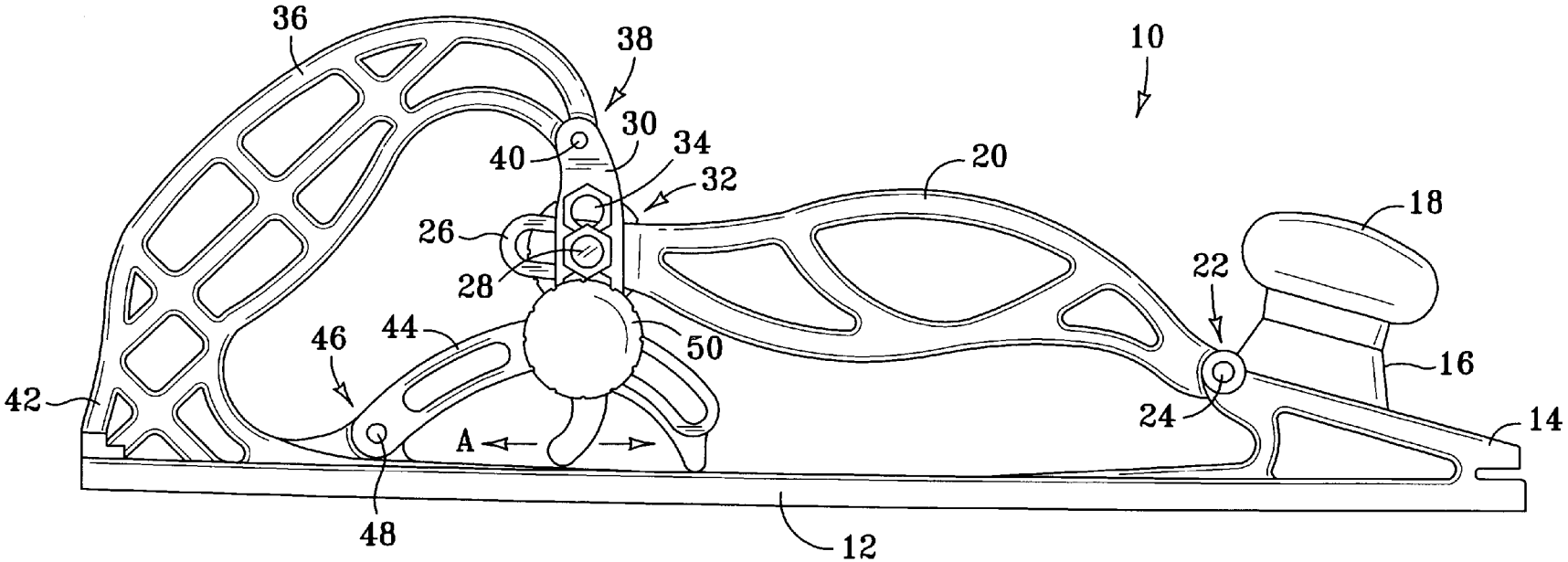
FIG. 2 schematically illustrates a side elevational view of the variable camber sanding board shown in FIG. 1.
Figure 3:
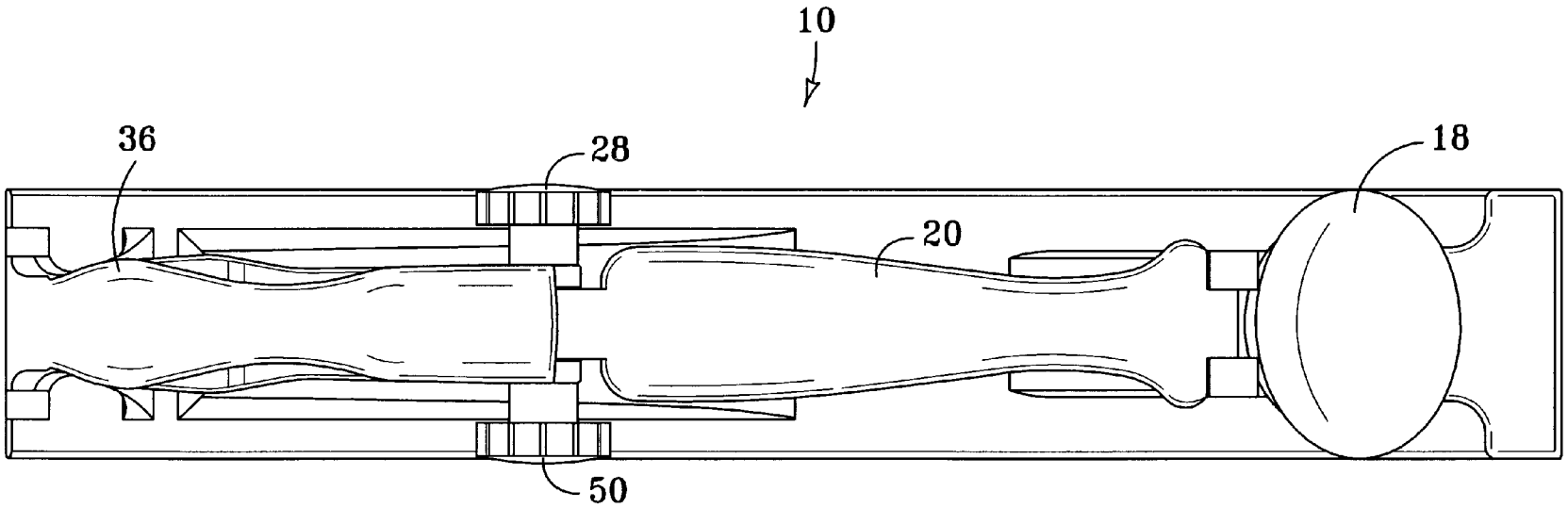
FIG. 3 illustrates a top plan view of the variable camber sanding board shown in FIG. 1.

While this invention is susceptible of embodiment in many different forms, there is shown in the drawings, and will herein be described in detail, exemplary embodiments, with the understanding that the present disclosure is to be considered as illustrative of the principles of the invention and not intended to limit the invention to the exemplary embodiments shown and described.

A variable camber sanding board in accordance with the principles of the present invention is shown in FIGS. 1 through 3. The sanding board 10 includes a generally planar sanding base 12. The sanding base 12 is relatively flexible, and is adapted to receive sanding media in the form of abrasive sheet material identical to those used with the Hand File Board available from 3M Company.

A front frame 14 is provided on the sanding base 12. A front handle 16 is mounted on the front frame 14, and is provided with a grip member 18. The front frame 14 is pivotably linked to a mid handle 20 via a front pivot connection 22. The front pivot connection 22 includes a pin 24 passing through coaxial bores formed in the mid handle 20 and front frame 14, respectively.

The mid handle 22 includes a slotted attachment member 26. A bolt assembly 28 pivotably secures the attachment member 26 to a trigger link 30, forming a middle pivot connection 32. The trigger link 30 includes a plurality of adjustment bores 34, which allow the location of the middle pivot connection 32 to be varied by selective placement of the bolt assembly 28 within the various adjustment bores 34.

The trigger link 30 is pivotably secured to a rear handle 36 via a rear pivot connection 38. The rear pivot connection 38 includes a pin 40 passing through coaxial bores formed in the trigger link 30 and the rear handle 36, respectively. The rear handle 36 is secured to the sanding base 12 via a rear frame 42.

A slot link 44 is pivotably secured to the rear frame 42 via an adjustment pivot connection 46. The adjustment pivot connection 44 includes a pin 48 passing through coaxial bores formed in the slot link 44 and rear frame 42, respectively. A threaded knob assembly 50 passes through a bore located in the trigger link 30 and a slot in the slot link 44. The knob assembly 50 can be selective tightened in place in a desired position along the length of the slot link 44.

Operation of the variable camber sanding board 10 is as follows. The knob assembly 50 is loosened, and the trigger link is moved in a desired direction along arrow A to provide the desired camber, either concave or convex. The knob assembly 50 is then tightened to secure the sanding board 10 in the desired position. The camber of the sanding board 10 is variable from radial to parabolic or progressive. The board can be fully locked, or the pivot connections and the overall geometry of the sanding board 10 can permit the sanding board to "float" during use.

The present invention can be made from any suitable material. It has been found that molding the sanding board 10 from a suitable thermoplastic material provides advantages in cost and weight, particularly a thermoplastic consisting of nylon 6 with 30% fiberglass.

While details of the invention are discussed herein with reference to some specific examples to which the principles of the present invention can be applied, the applicability of the invention to other devices and equivalent components thereof will become readily apparent to those of skill in the art.

Accordingly, it is intended that all such alternatives, modifications, permutations, and variations to the exemplary embodiments can be made without departing from the scope and spirit of the present invention.

What is claimed is:

1. A variable camber contouring apparatus comprising the following:

a front frame;

a flexible sanding base secured to the front frame, the sanding base being adapted and constructed to receive abrasive sheet material;

a front handle mounted on the front frame;

a rear grip member secured to the sanding base; and at least one selectively securable pivot connection linking the front frame to the rear grip member, whereby the flexible sanding base can be flexed to vary the camber of the abrasive sheet material.

2. A variable camber contouring apparatus in accordance with claim 1, further comprising a mid handle member secured between the front handle and the rear grip member.

3. A variable camber contouring apparatus in accordance with claim 2, wherein the at least one pivot connection comprises a front pivot connection.

4. A variable camber contouring apparatus in accordance with claim 3, wherein the front pivot connection comprises the following:

a bore formed in the mid handle member;

a bore formed in the front frame, the bore in the front frame being coaxial with the bore in the mid handle member; and a pin passing through the bores in the mid handle member and the front frame.

5. A variable camber contouring apparatus in accordance with claim 2, wherein the at least one pivot connection comprises a middle pivot connection.

6. A variable camber contouring apparatus in accordance with claim 5, wherein the middle pivot connection comprises the following:

a slotted attachment member formed in the mid handle member;

a trigger link including a plurality of adjustment bores; and a bolt assembly pivotably securing the slotted attachment member to the trigger link, whereby the location of the middle pivot connection is varied by selective placement of the bolt assembly within the respective adjustment bores.

7. A variable camber contouring apparatus in accordance with claim 2, wherein the at least one pivot connection comprises a rear pivot connection.

8. A variable camber contouring apparatus in accordance with claim 7, wherein the rear pivot connection comprises the following:

a trigger link including a bore;

a bore formed in the rear handle member, the bore in the rear handle member being coaxial with the bore in the trigger link; and a pin passing through the bores in the trigger link and the rear handle.

9. A variable camber contouring apparatus in accordance with claim 2, wherein the at least one pivot connection comprises an adjustment pivot connection.

10. A variable contouring apparatus in with claim 9, wherein the adjustment pivot connection comprises the following:

a rear frame securing the rear handle to the sanding base, the rear frame including a bore;

a slot link including a slot and a bore, the bore in the slot link being coaxial with the bore in the rear frame;

a pin passing through the coaxial bores in the slot link and the rear frame; a trigger link including a bore; and a threaded knob assembly passing through the bore located in the trigger link and the slot in the slot link, whereby the knob assembly can be selectively tightened in place in a desired position along a length of the slot link.

11. A variable camber contouring apparatus comprising the following:

a front frame;

a flexible sanding base secured to the front frame, the sanding base being adapted and constructed to receive abrasive sheet material;

a front handle mounted on the front frame;

a rear grip member secured to the sanding base;

a mid handle member pivotally suspended over the flexible sanding base between the front handle and the rear grip member; and at plurality of selectively securable pivot connections linking the front frame to the rear grip member, whereby the flexible sanding base can be flexed to vary the camber of the abrasive sheet material.

12. A variable camber contouring apparatus in accordance with claim 11, wherein the plurality of pivot connections comprise a front pivot connection, a middle pivot connection, a rear pivot connection, and an adjustment pivot connection.

13. A variable camber contouring apparatus in accordance with claim 12, wherein the front pivot connection comprises the following:

a bore formed in the mid handle member;

a bore formed in the front frame, the bore in the front frame being coaxial with the bore in the mid handle member; and a pin passing through the bores in the mid handle member and the front frame.

14. A variable camber contouring apparatus in accordance with claim 12, wherein the middle pivot connection comprises the following:

a slotted attachment member formed in the mid handle member;

a trigger link including a plurality of adjustment bores; and a bolt assembly pivotably securing the slotted attachment member to the trigger link, whereby the location of the middle pivot connection is varied by selective placement of the bolt assembly within the respective adjustment bores.

15. A variable camber contouring apparatus in accordance with claim 12, wherein the rear pivot connection comprises the following:

a trigger link including a bore;

a bore formed in the rear handle member, the bore in the rear handle member being coaxial with the bore in the trigger link; and a pin passing through the bores in the trigger link and the rear handle.

16. A variable camber contouring apparatus in accordance with claim 12, wherein the adjustment pivot connection comprises the following:

a rear frame securing the rear handle to the sanding base, the rear frame including a bore;

a slot link including a slot and a bore, the bore in the slot link being coaxial with the bore in the rear frame;

a pin passing through the coaxial bores in the slot link and the rear frame; a trigger link including a bore; and a threaded knob assembly passing through the bore located in the trigger link and the slot in the slot link, whereby the knob assembly can be selectively tightened in place in a desired position along a length of the slot link.

17. A method contouring a curved surface, the method comprising the following steps:

providing a variable camber contouring apparatus including a front frame, a flexible sanding base secured to the front frame, the sanding base being adapted and constructed to receive abrasive sheet material, a front handle mounted on the front frame, a rear grip member secured to the sanding base, and a plurality of selectively securable pivot connections linking the front frame to the rear grip member;

securing abrasive material to the sanding base;

securing the pivot connections to flex the sanding base to provide a camber of the abrasive sheet material suitable to the curved surface; and bringing the abrasive material on the sanding base of the contouring apparatus into contact with the curved surface to contour the curved surface.

18. A method in accordance with claim 17, wherein the step of providing a variable camber contouring apparatus further comprises providing a mid handle member secured between the front handle and the rear grip member.

19. A method in accordance with claim 17, wherein the step of providing a variable camber contouring apparatus further comprises providing a front pivot connection, a middle pivot connection, a rear pivot connection, and an adjustment pivot connection.

* * * * *